United States Patent [19]

Thompson

[11] Patent Number: 4,995,454

[45] Date of Patent: Feb. 26, 1991

[54] HEAT EXCHANGER WITH CORRUGATED TUBES

[76] Inventor: Donovan S. Thompson, 2727 Lincolnwood Dr., Racine, Wis. 53403

[21] Appl. No.: 438,309

[22] Filed: Nov. 17, 1989

[51] Int. Cl.[5] ..... F28D 7/10

[52] U.S. Cl. ..... 165/155; 165/154; 165/164

[58] Field of Search ..... 165/154, 155, 164

[56] References Cited

U.S. PATENT DOCUMENTS

| | | | |
|---|---|---|---|
| 351,585 | 10/1886 | Edmiston | 165/161 |
| 565,828 | 8/1896 | Best | 165/155 |
| 1,336,225 | 4/1920 | Hardie | 165/154 X |
| 2,576,309 | 11/1951 | Ruemelin | 257/228 |
| 3,934,618 | 1/1976 | Henderson | 138/114 |
| 3,968,346 | 7/1976 | Cooksley | 219/305 |
| 4,204,573 | 5/1980 | Clark | 165/142 |
| 4,270,601 | 6/1981 | Lancaster | 165/154 |
| 4,437,513 | 3/1984 | Castiglioni et al. | 165/154 |

FOREIGN PATENT DOCUMENTS

| | | | |
|---|---|---|---|
| 137698 | 7/1901 | Fed. Rep. of Germany | 165/155 |
| 3024 | of 1874 | United Kingdom | 165/166 |
| 112362 | 1/1918 | United Kingdom | 165/154 |

*Primary Examiner*—Alan Cohan
*Assistant Examiner*—Allen J. Flanigan
*Attorney, Agent, or Firm*—Arthur J. Hansmann

[57] ABSTRACT

A heat exchanger with two concentrically disposed corrugated tubes nested one within the other for the flow of two separated fluids through the exchanger. Each tube has convolutions, and fluid openings or passageways exist for directing flow completely through each convolution of each tube for optimum heat exchange. Endplates are provided on the exchanger for assembly, and also for ease of repair and cleaning of the exchanger. The arrangement of the convolutions and openings is such that a cardioid flow pattern is obtained for the maximum efficiency of heat exchange.

18 Claims, 2 Drawing Sheets

HEAT EXCHANGER WITH CORRUGATED TUBES

This invention pertains to a heat exchanger of the type having two corrugated tubes of different diameters and which are concentrically disposed on the same axis.

BACKGROUND OF THE INVENTION

The prior art is already aware of heat exchangers utilizing corrugated tubes for the heat transfer members which contain and conduct the flow of fluid relative thereto. Examples of heat exchangers with only one corrugated tube incorporated therein are seen in U.S. Pat. Nos. 4,270,601 and 4,437,513.

As mentioned, the present invention utilizes two corrugated tubes disposed on a common axis, and examples of the prior art of that general concept are seen in U.S. Pat. Nos. 2,576,309 and 3,934,618.

In all of the aforementioned examples, the fluids flow separately and independently in each respective tube. In the present invention, the two fluids flow in the required separated paths, but they both flow in contact with each of the corrugated tubes. In fact, one of the fluids flows from the interior of one tube to the exterior of the other tube, and the other fluid flows from the exterior of one tube to the interior of the other tube. In this manner, optimum heat transfer is obtained since there is the desirable function of maximum turbulence in the flow of the fluids through the exchanger, and thus there is maximum contact of the fluids with the walls of the tubes where heat transfer is taking place.

Accordingly, the present invention improves the heat transfer between the fluids, and it also improves the fluid contacting the surface of the transfer material itself which is separating the fluids from each other, and thereby optimum heat transfer efficiency is attained.

Still further, the present invention provides the corrugated type of heat exchanger and wherein there is only minimal opportunity for leakage of the fluids from the exchanger or from one fluid passageway to the other fluid passageway within the exchanger. That is, the heat exchange surfaces themselves are of one continuous tube, and the ends of the tubes are sufficiently sealed with regard to the exchanger headers to thereby minimize the possibilities of fluid leakage within the exchanger.

Still further, the exchanger of the present invention provide for the flow of fluids in an extended path of flow through the exchanger, and that path being a serpentine path so that there is maximum contact of the fluid with the exchanger heat transfer surfaces, at least for a given total length of the exchanger itself. This is accomplished by having the fluid flow in the pattern of the corrugations itself, rather than directly past the corrugations and not into the outer radial extents defined by the corrugations of the heat exchanger tubes.

U.S. Pat. No. 4,204,573 shows a heat exchanger which is simply of a straight tubular construction, rather than corrugated tubes, and it has a flow path which causes the fluids to circulate within the exchanger in a reverse pattern of flow, rather than moving directly through the exchanger. However, that arrangement is not with regard to corrugated tubes which direct the flow between the interior and exterior of the two corrugated tubes and which direct the flow into all regions of the convolutions of the corrugations themselves, as in the present invention.

In the present invention, the fluids may be either liquid or gas, including steam and air, and the two fluids flowing through the exchanger may be in any combination of liquid and gas in their respective two paths and within the confinement of the respective corrugated tubes. Still further, the exchanger of the present invention provides a construction which lends itself to easy and ready disassembly for cleaning, inspection, and the like.

Also, the exchanger of this invention accomplishes the afore mentioned, particularly with regard to presenting optimum serpentine flow and maximum heat exchanger surface area, and does so with a construction which is sturdy and is arranged to withstand internal and external fluid pressures without damage to the tubes or convolutions thereof. That is, the external pressures on the convolutions will not cause the convolutions to distort or further collapse, since the radius at the tips of the convolutions is such that the radial tips structurally support the planar portions intermediate the radial tips and thereby preclude collapse of the convolutions which are subjected to high fluid pressures. Further, for optimum heat exchange efficiency, the flow pattern of the fluid relative to both of the tubes and their respective convolutions is in a cardioid pattern which thereby divides the flow into two directions and thus results in the optimum heat exchange efficiency.

BRIEF DESCRIPTION OF THE DRAWINGS

FIG. 3 is a broken away at its bottom portion.

DETAILED DESCRIPTION OF THE PREFERRED EMBODIMENT

Figure 1:
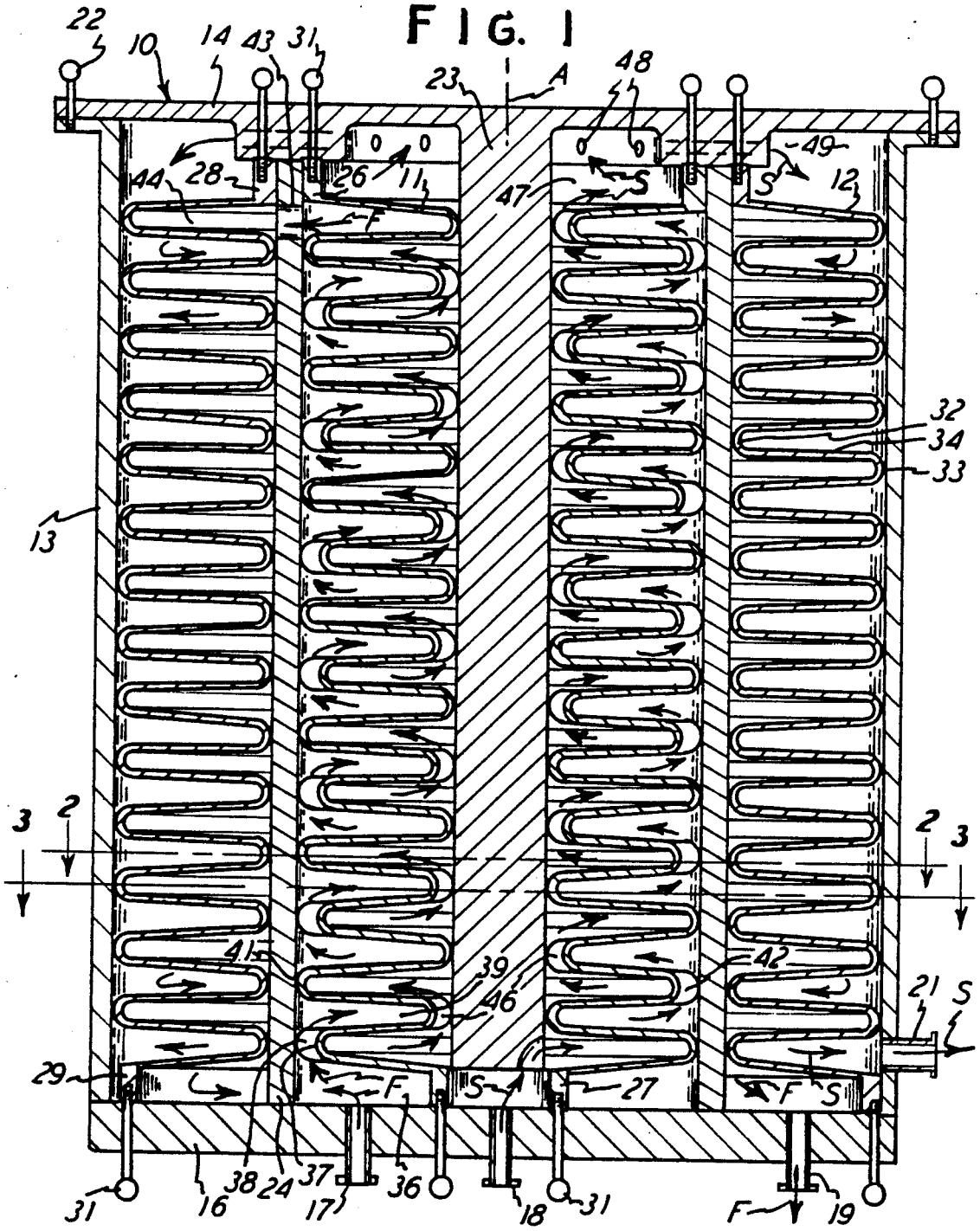
FIG. 1 is a longitudinal sectional view through a preferred embodiment of the heat exchanger of this invention, and the section is taken along the line 1—1 of FIG. 2.

This exchanger consists generally of a housing, generally designated 10, and two corrugated tubes 11 and 12 concentrically disposed within the housing 10 and on the same longitudinal axis thereof, such as on the line designated A. The housing includes a circular body 13 and an endplate 14 and an endplate 16. In any suitable manner, the body 13 and plates 14 and 16 are suitably connected together to be fluid tight relative to each other, except for the fluid inlets 17 and 18 and the fluid outlets 19 and 21. For further disclosure, bolt members 22 are shown connecting the endplate 14 to the body 13, and suitable bolts are utilized for connecting the plate 16 to the body 13.

The exchanger also has a central cylindrical post 23 which extends for substantially the axial length of the exchanger and is of course concentric to the longitudinal axis A. The tube 11 is concentrically disposed about the post or partition 23 and for substantially the length thereof, as shown in FIG. 1. Also disposed within the exchanger is a cylindrical partition 24 which is shown to extend between the endplates 14 and 16 and which is fluid tight therewith and which is also concentric with the central axis A. Finally, the tube 12 is disposed within the exchanger and on the exterior of the cylindrical partition 24 and is also concentric about the longitudinal axis A.

In that arrangement, the two tubes 11 and 12 and the two partitions 23 and 24 are all concentrically arranged about the axis A and extend for substantially the length of the entire exchanger, as shown.

It will also be seen and understood that the opposite ends of both tubes 11 and 12 have cylindrical portions 26, 27, and 28, 29 and these portions are on the respective tubes 11 and 12, as shown, and are fluid tightly connected with the respective endplates 14 and 16, such as by means of the connecting threaded-type bolt members 31.

In that arrangement, the tubes 11 and 12 are fluid tight relative to each other, and they are also fluid tight relative to the endplates 14 and 16. The entire arrangement is such that two separated fluids entering the two inlets 17 and 18 will remain separated from each other throughout the exchanger and they will flow through the exchanger and respectively exit the exchanger at the outlet connections 19 and 21. As mentioned, it will also be understood that the two separated fluids do not leak from their respective paths, hereinafter described, as they flow through the exchanger and make their final exit through the outlet openings 19 and 21.

In more detail, the two tubes 11 and 12 are corrugated tubes with each having a sequence of annular convolutions spaced along the axial length of each of the tubes, as shown. Further, the tube 11 is of a smaller overall diameter relative to the tube 12, and in fact the outer diameter of the smaller tube 11 is less than the inner diameter of the larger tube 12, all as clearly shown in FIG. 1. Also, the tubes 11 and 12 are not physically attached to the exterior exchanger cylindrical body 13 nor to the two partitions 23 and 24, and the tubes are in substantially fluid tight contact with the body 13 and the two partitions 23 and 24, except for openings hereinafter described, and therefore the corrugated tubes 11 and 12 are free to move slightly relative to the body 13 and the two partitions 23 and 24 to accommodate manufacturing tolerances as well as expansion and contraction caused by the fluids flowing adjacent the respective tubes.

Each tube 11 and 12 consists of the inner radial portion and the outer radial portion and with the two radial portions connected by a planar surface. For example, in connection with the tube 12, there is the inner radial portion 32 and the outer radial portion 33 and the inner connecting planar portion 34. The radial portions 32 and 33 are therefore slightly less than a semi-circle in configuration, and the planar portion 34 is coincident with the two radial portions 32 and 33, as shown. With that arrangement, fluid pressure, or mechanical pressure, on either the interior or exterior of either tube 11 or 12, will not distort the tube since the less than semicircular portions 32 and 33 will resist any such distortion because distortion can occur only upon the mutual collapsing of one radial portion and the extended distortion of the adjacent radial portion, and that occurrence is mechanically resisted by the nature of the configuration as described herein.

It will also be understood that the word "convolution" means the complete annular portion of either tube 11 or 12 considered between two consecutive radially inward or radially outward portions 32 or 33. That is, one complete loop having two planar portions 34 and the adjacent radial portions constitutes a convolution.

With further description of the structure, and the following description of the flow patterns of the two fluids through the exchanger, one skilled in the art will even more fully understand the full disclosure of this invention. Accordingly, considering a first fluid entering the inlet connector 17, the fluid flows in the direction of the arrows designated F, and it will be seen that the fluid first enters an annular chamber 36. It will also be seen and understood that the lower convolution of the tube 11 is foreshortened at the radial outer extent designated 37, and thus it leaves an opening designated 38 for the flow of the first fluid along the path designated F. Thus the fluid flows in full contact with the lower convolution of the smaller diameter and inner tube 11, and it flows upwardly beyond the lower convolution and to between the lowest and the second lowest convolution of the tube 11 and into that chamber designated 39. With the outer radial portion 41 being substantially fluid tight with the partition 24, the fluid continues to flow around the two lower convolutions and to the diametrically opposite side from the chamber 39 and into an opening 42 which exists between the radial outer portion and the partition 24, as shown by the flow pattern arrows.

Therefore, the first fluid follows the flow designated by the arrows F and that flow is on the exterior of the smaller diameter inner tube 11 and the flow continues upwardly along the tube 11 passing through the alternating fluid openings such as 38 and 42 spaced along the tube 11.

It will also be seen and understood that in each instance of the fluid flowing into and out of the openings 38 and 42 and the like, the fluid will flow in two opposite directions in a cardioid pattern and to the diametrically opposite side of the tube 11, and thus maximum fluid contact with the tube 11 is achieved and thus maximum heat exchange efficiency is achieved. The first fluid will continue to flow upwardly on the exterior of the inner diameter tube 11 and to a location adjacent the upper plate 14 where the first fluid can flow through a passageway 43 in the cylindrical partition 24, and that passageway 43 is in flow communication with the interior 44 of the larger diameter and outer tube 12. Therefore, the first fluid flows through the inside of the tube 12 and in a downward pattern, again making the cardioid patterns because of the provision and location of fluid openings, namely the openings designated 44 and shown in FIG. 2, and will be understood that all the fluid passage openings between the tubes 11 and 12 and their adjacent partition portions are of the same pattern, namely, with respect to every consecutive convolution of both tubes 11 and 12, such as shown and described in connection with the smaller diameter tube 11.

With that flow pattern of the first fluid the fluid continues to flow downwardly through the interior of the tube 12 and finally in the flow pattern designated by the arrow F in the lower right hand corner of FIG. 1 and then out the outlet 19.

In summary and with regard to the flow of the first fluids as designated by the arrows F, the fluid flows around the exterior of the smaller diameter tube 11 and into the interior of the larger diameter tube 11, and in all instances each convolution of each tube provides for the cardioid flow pattern so that the fluid fully flows through each convolution and thus provides optimum heat exchange.

Next, tracing the flow pattern of the second fluid which enters the inlet 18, that fluid pattern is shown by the arrows designated S. Thus the second fluid enters the inside of the lower convolution of the smaller diameter tube 11, and that fluid continues in its cardioid pattern until it enters the opening 46 and thus passes into the inside of the next upper convolution in the tube 11 and continues its cardioid flow pattern through the openings 46 which are located relative to each consecutive convolution, as shown. The second fluid flows upwardly in the exchanger and into the upper chamber 47 where it enters openings 48 and flows into an exchanger chamber 49 which is on the exterior of the larger diameter tube 12. The fluid then flows around the exterior of the larger diameter tube 12 which forms openings 51 with the exchanger partition 13, and the fluid therefore flows downwardly in the exchanger, as viewed in FIG. 1, until the fluid flows out the outlet 21. Again, the cardioid pattern of flow is achieved by virtue of the fluid-tight relationship of the tube convolutions relative to the exchanger body 13 which is a partition, and by virtue of the location of the fluid openings 51.

It will therefore be noticed that the flow pattern with regard to the second fluid, as designated by the arrows S, flows from the interior of the smaller diameter tube 11 to the exterior of the larger diameter tube 12, and thus complete turbulence and consequent heat transfer efficiency is achieved.

Also, since the tubes 11 and 12 are continuous and therefore integral throughout their entire lengths, they need only be connected to the plates 14 and 16 in fluid-tight relations therewith to avoid any internal leaking. Where the plates 14 and 16 are fluid tight with the members they respectively contact, there can be no leaking in the entire exchanger. Also, the plates 14 and 16 can be removed for cleaning of the exchanger, and in fact the tubes 11 and 12 can also be removed along with the cylindrical partition 24 for thorough cleaning of the complete exchanger, if and when desired.

Of course it will also be seen and understood that in each instance of providing the flow openings adjacent the convolutions of the respective tubes 11 and 12, the openings are arranged by virtue of providing indented convolution to thereby space it relative to the adjacent partition. The tubes 11 and 12 are therefore corrugated tubes with a plurality of convolutions spaced axially therealong, and in all instances the flow goes completely either into or around each convolution and in flow contact with each radial portion and each planar portion of each convolution, all by virtue of the arrangement and location of the flow openings which produces the cardioid flow pattern described and as indicated by the flow arrows shown in FIGS. 2 and 3.

Figure 2:
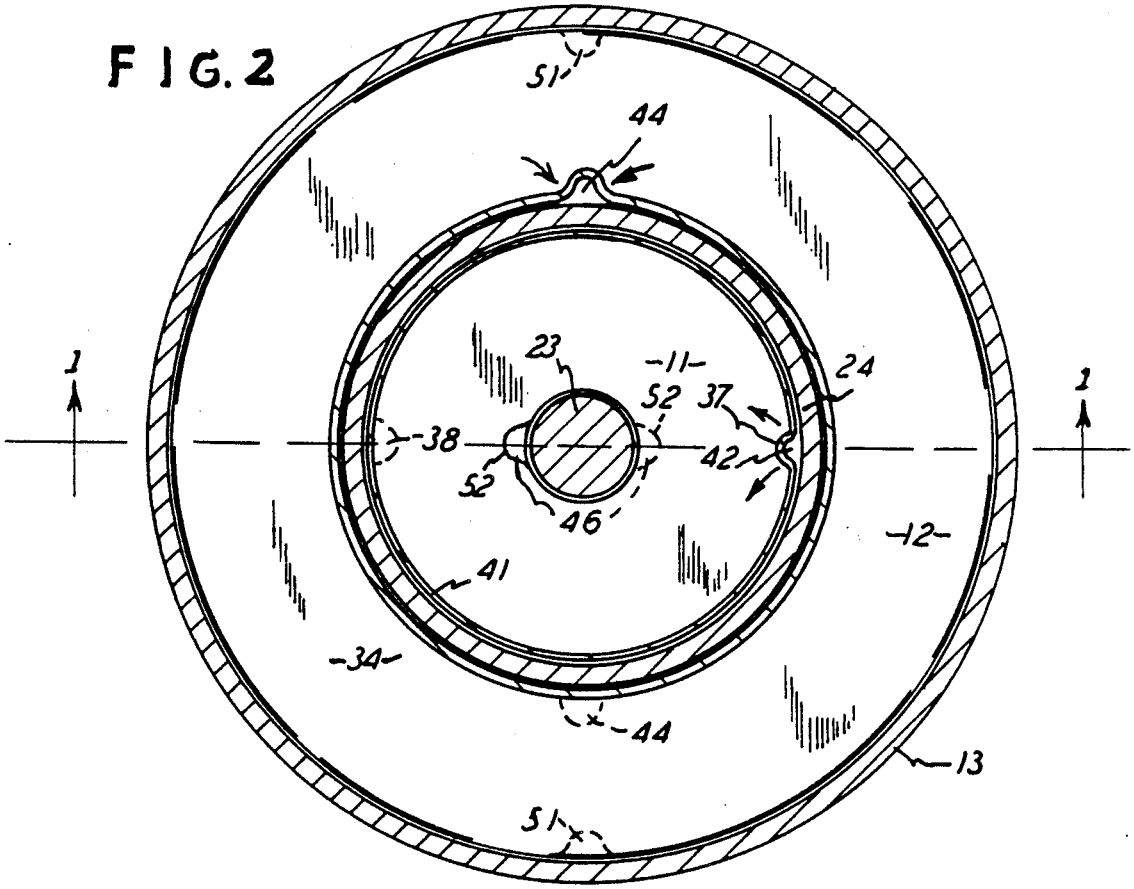
FIGS. 2 and 3 are sectional views taken along the respective lines 2—2 and 3—3 of FIG. 1.
Figure 3:
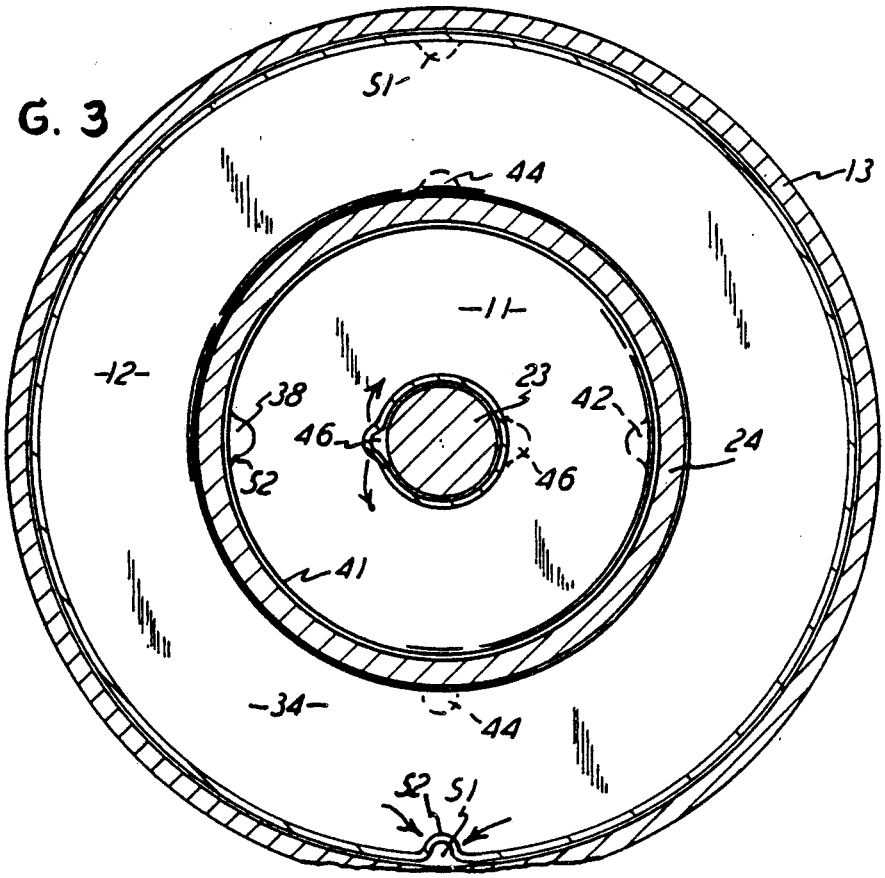

Thus it will be seen and understood that the flow openings 38, 42, 44, 46, and 51 exist relative to each and every convolution on the respective tubes 11 and 12. The aforesaid openings are provided by the indentations or dimples 52 on the respective tube radial portions 32 and 33, as shown. Because the tubes 11 and 12 are not physically attached to their adjacent partitions 23, 24, and 13, FIGS. 2 and 3 show slight clearances with those partitions, for the purpose of emphasizing the absence of physical attachment. However, as mentioned, it will be understood that the tubes are fluid tight with the respective partitions, except for the flow openings described and shown.

What is claimed is:

1. In a heat exchanger of the type having two corrugated tubes with each having a plurality of convolutions therealong and said tubes being of different diameters and with one thereof inside the other for the flow of two separated fluids as confined by and relative to each of said tubes in the exchange of heat therebetween, the improvement comprising each of said tubes having partitions in contact with the inner and outer diameters of said tubes and extending the lengths of said tubes for respectively confining the flow of the fluids relative to the inner and outer diameters of said tubes and fully into said convolutions, and said exchanger having fluid passageways for detecting the flow of the fluid through said exchanger.

2. The heat exchanger as claimed in claim 1, wherein said partitions are cylindrical members with one thereof disposed along the interior of the smaller diameter said tube and two others thereof disposed along the outer diameters of both of said tubes.

3. The heat exchanger as claimed in claim 2, wherein one of said fluid passageways is located and extends to direct the flow of one fluid from the interior of said smaller diameter tube to the exterior of the other one of said tubes, and another one of said fluid passageways is located and extends to direct the flow of the other of said fluids from the exterior of said smaller diameter tube to the interior of said other one of said tubes.

4. The heat exchanger as claimed in claim 1, wherein said fluid passageways are arranged to direct the flow of the fluids from each of said tubes to the other of said tubes.

5. The heat exchanger as claimed in claim 4, wherein said fluid passageways are arranged to direct the flow of one of said fluids from the interior of one of said tubes to the exterior of the other of said tubes, and vice versa with regard to the other of said fluids.

6. The heat exchanger as claimed in claim 4, wherein said fluid passageways include two fluid inlet openings and two fluid outlet openings all adjacent one axial end of said tubes for the separated flow of the respective two fluids.

7. The heat exchanger as claimed in claim 1, including fluid-flow openings spaced along at least one of said tubes and at least one of said partitions, and therebetween, for the flow of fluid through said openings and successively from each of said convolutions to a convolution adjacent said each convolution.

8. The beat exchanger as claimed in claim 7, wherein each of said convolutions respectively define said openings at either one of the inner and outer diameters of said corrugated tubes.

9. The heat exchanger as claimed in claim 8, wherein said openings are spaced at every other one of said convolutions and as both the inner and outer diameters of said corrugated tube.

10. The heat exchanger as claimed in claim 1, including a removable cover dispersed on the axis of said tubes for the draining and cleaning of the exchanger.

11. The heat exchanger as claimed in claim 1, wherein each said convolution includes a less than semi-conductor radial portion and a planar portion tangential to said radial portion and oblique to the axis of said tube, for avoidance of collapse of said convolutions when under fluid pressure.

12. The heat exchanger as claimed in claim 7, wherein said convolutions include radial portions and said openings are adjacent said radial portions to thereby have fluid flow through said openings and around said convolutions in a cardioid pattern.

13. The heat exchanger as claimed in claim 1, including fluid-flow openings between said partitions and said convolutions for the flow of fluid therethrough, and with said openings being disposed radially inwardly on every other one of said convolutions, and also being disposed radially outwardly on every other one of said convolutions which are different ones of said convolutions compared to said convolutions with said radially inwardly disposed openings.

14. In a heat exchanger of the type including a corrugated tube having a plurality of convolutions therealong with inner and outer diameters and with the exchanger arranged for the flow of two separated fluids respectively on the inside and the outside of said tube for the exchange of heat between said fluids, the improvement comprising partitions in respective contact with said inner and outer diameters of said convolutions and extending the length of said tube for respectively confining the flow of the fluids relative to the inner and outer diameters of said convolutions, flow openings spaced along said tube and said partitions, and therebetween, for the flow of fluid through said openings and successively from each of said convolutions to a convolution adjacent said each convolution, and said exchanger having fluid passageways for directing the flow of the fluids through said exchanger.

15. The heat exchanger as claimed in claim 14, wherein each of said convolutions respectively define said openings at either one of the inner and outer diameters of said corrugated tube.

16. The heat exchanger as claimed in claim 15, wherein said openings are spaced at every other one of said convolutions and at both inner and outer diameters of said corrugated tube.

17. The heat exchanger as claimed in claim 14, wherein said convolutions include radial portions and said openings are adjacent said radial portions to thereby have fluid flow through said openings and around said convolutions in a cardioid pattern.

18. The heat exchanger as claimed in claim 14, including fluid-flow openings between said partitions and said convolutions for the flow of fluid therethrough, and with said openings being disposed radially inwardly on every other one of said convolutions which are different ones of said convolutions compared to said convolutions with said radially inwardly disposed openings.

* * * * *

UNITED STATES PATENT AND TRADEMARK OFFICE

CERTIFICATE OF CORRECTION

PATENT NO. : 4,995,454

DATED : 26 February, 1991

INVENTOR(S) : Donovan S. Thompson

It is certified that error appears in the above-identified patent and that said Letters Patent is hereby corrected as shown below:

In Claim 1, column 6, line 5, "fluid" should be --fluids--.

In Claim 9, column 6, line 46, "as" should be --at--.

In Claim 10, column 6, line 49, "dispersed" should be --disposed--.

In Claim 11, column 6, lines 52 and 53, "semi-conductor" should be --semi-circular--.

Signed and Sealed this

Seventeenth Day of March, 1992

*Attest:*

HARRY F. MANBECK, JR.

*Attesting Officer*

*Commissioner of Patents and Trademarks*